US005785274A

United States Patent [19]

Johnson

[11] Patent Number: 5,785,274

[45] Date of Patent: Jul. 28, 1998

[54] CENTER FEED TOILET PAPER DISPENSER

[76] Inventor: John R. Johnson, 26653 Cotton Bayon Dr., Orange Beach, Ala. 36561

[21] Appl. No.: 763,196

[22] Filed: Dec. 10, 1996

Related U.S. Application Data

[63] Continuation-in-part of Ser. No. 414,311, Mar. 31, 1995, Pat. No. 5,582,362.

[51] Int. Cl.[6] ..... B65H 16/02

[52] U.S. Cl. ..... 242/593

[58] Field of Search ..... 242/423, 423.1, 242/593; 225/39, 51, 52, 79, 81; 206/406, 407, 408, 409; 312/34.1, 34.24, 242

[56] References Cited

U.S. PATENT DOCUMENTS

| | | | |
|---|---|---|---|
| 1,819,122 | 8/1931 | Resnati | 242/593 |
| 3,523,653 | 8/1970 | Hansen | 242/593 |
| 3,627,216 | 12/1971 | Ekuan | 242/593 |
| 4,936,452 | 6/1990 | Pauley | 225/52 |
| 5,065,924 | 11/1991 | Granger | 225/46 |
| 5,100,038 | 3/1992 | Schafer | 225/52 |
| 5,141,171 | 8/1992 | Yang | 242/493 |
| 5,205,455 | 4/1993 | Moody | 206/409 |
| 5,219,126 | 6/1993 | Schutz | 206/409 |
| 5,346,064 | 9/1994 | Rizzuto | 206/409 |
| 5,370,338 | 12/1994 | Lewis | 242/593 |
| 5,570,938 | 11/1996 | Butler | 312/34.1 |
| 5,582,362 | 12/1996 | Johnson et al. | 242/593 |

FOREIGN PATENT DOCUMENTS

| | | | |
|---|---|---|---|
| 2073931 | 1/1993 | Canada | 242/593 |
| 0 107 487 A1 | 5/1984 | European Pat. Off. | 242/593 |
| 2 535 696 | 5/1984 | France | 242/593 |
| WO 81/02880 | 10/1981 | WIPO | 242/593 |

*Primary Examiner*—John P. Darling

[57] ABSTRACT

An apparatus for containing and dispensing toilet paper. The apparatus holds the toilet paper roll in a stationary position as the loose paper end is pulled from the inner core of the paper roll. A housing for containing the paper roll is attached to a base, and a cover engaged with the housing compresses the paper roll against the base. This compression prevents sag of the layered toilet paper roll as the void in the paper core becomes enlarged.

5 Claims, 2 Drawing Sheets

CENTER FEED TOILET PAPER DISPENSER

This patent application is a continuation-in-part patent application of U.S. Ser. No. 08/414,311 filed Mar. 31, 1995, by John R. Johnson and issuing Dec. 10, 1996, as U.S. Pat. No. 5,582,362.

BACKGROUND OF THE INVENTION

The present invention relates to an improved apparatus for dispensing toilet paper and other roll paper products. More particularly, the present invention relates to a dispenser for statically containing a toilet paper roll and for permitting the selective withdrawal of toilet paper from the stationary roll.

Toilet paper rolls comprise a perforated paper strip wound about a cardboard core. A spindle is inserted through the cardboard core to facilitate the dispensing of the toilet paper. The toilet paper roll rotates about the spindle as toilet paper is unraveled from the exterior surface of the roll. A toilet paper roll section is removed by tearing the roll along a row of perforations.

The cardboard core of toilet paper rolls untimately become a discarded waste product. This waste core creates excess paper waste for landfills, and adds additional shipping weight to the paper product. The extra shipping weight increases product cost and reduces the overall efficiency of toilet paper dispensing.

To remove a piece of toilet paper from a conventional toilet paper holder, the loose end of the toilet paper roll is pulled to rotate the toilet paper roll and cardboard core about the spindle. Two ply paper is typically preferred for this use because a single ply toilet paper roll may prematurely trear. Because the two ply roll contains twice the paper of a single ply roll, for the same number of sheets, two ply rolls are less efficient and therefore waste more paper.

In commercial and public installations, oversized toilet paper rolls are typically stored in oversized paper dispensers. The oversized toilet paper rolls reduce the labor cost incurred in replenishing the rolls, since the oversized rolls hold more paper. However, oversized paper rolls are susceptible to vandalism and overconsumption of the toilet paper. The extra weight of the oversized paper roll experiences a higher angular momentum when the loose toilet paper end is pulled. If the toilet paper does not separate cleanly on this first tug, the entire roll can rotate about the spindle to expose more paper than desired. In maintenance operations, it is not uncommon to discover that vandals have destroyed the utility of a toilet paper roll by spinning an entire toilet paper roll onto the floor.

One effort to create a static paper dispenser for paper towells is illustrated in U.S. Pat. No. 5,065,924 to Granger (1991), wherein paper towels are dispensed from a cylindrical, wall mounted container. As shown in this patent, paper towels are helically withdrawn from the center portion of the paper towel roll along a horizontal axis. To prevent the paper towel roll from sagging within the container, a cylindrical plate is spring biased against one side of the paper towel roll. This cylindrical plate increases the weight, cost and possibility of mechanical failure of the dispenser. In another embodiment, double sided adhesive strips are adhered to the upper portion of the paper towel roll to prevent sagging. These adhesive strips require labor to install and require mechanical connection to the upper portion of the dispenser.

A need exists for an improved apparatus for dispensing light weight paper products such as toilet paper. Preferably, the apparatus should facilitate the use of lighter weight and economical single ply toilet paper products to prevent economic and material waste.

SUMMARY OF THE INVENTION

The present invention improves the containment and dispensing of paper products such as a cylindrical toilet paper roll by providing a static roll dispenser that permits withdrawal of a loose paper end from the roll center.

The invention comprises a housing defining an interior space for holding the toilet paper roll, a base attached to said housing for contacting one planar surface of the paper roll, a cover engaged with the housing to retain the paper roll within the housing interior space, and an aperture in the cover for permitting the loose paper end to be withdrawn through the cover.

In another embodiment of the invention, the housing can be attached to a ceiling so that the loose paper end is withdrawn downwardly through an aperture. The toilet paper can be inserted into the housing from the upper or lower side of the housing, and a tube can protect the downward movement of the paper.

DESCRIPTION OF THE PREFERRED EMBODIMENTS

Figure 1:
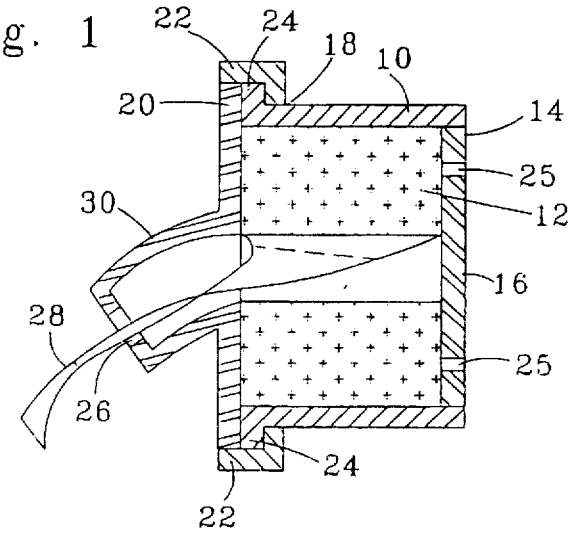
FIG. 1 illustrates a side elevation view in crossection of the present invention.

The present invention provides an apparatus for containing and dispensing a cylindrical toilet paper roll. Referring to FIG. 1, housing 10 is illustrated in conjunction with toilet paper roll 12. As illustrated, toilet paper roll is a conventional toilet paper roll but does not have an inner cardboard core. Housing 10 has first end 14 attached to base 16 and second end 18 attached to cover 20. Clasps 22 detachably engage cover 20 with housing 10.

Figure 2:
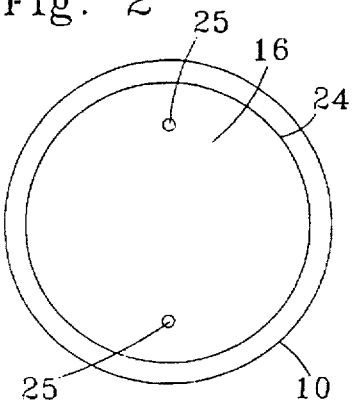
FIG. 2 illustrates a front elevation view of the housing without a cover.

Although clasps 22 are shown as locking clips, clasps 22 can comprise any structural or mechanical configuration capable of engaging cover 20 with housing 10. For example, clasps 22 could comprise hinges or pins for permitting pivotable engagement of cover 20 with housing 10, could comprise male tabs on cover 20 for engaging with female sockets in housing 10, could comprise hooks, screws, bolts, snap rings, clips, and many other physical or structural combinations. As shown in FIG. 1, clasps 22 can engage lip 24 formed in the exterior surface of housing 10. Cover 20 can be permanently connected with housing 10 or can be completely removeable as shown in FIG. 2.

Base 16 can comprise a solid member or can comprise a rigid bar or web attached to housing 10. In a preferred embodiment of the invention, base 16 can be formed integrally with housing 10 to eliminate joints therebetween. Base 16 can rest loosely on the top of a horizontal surface or can be rigidly fastened to a ceiling, the top of a horizontal surface or to a vertical wall surface. Such attachment can be made with glue or adhesives, with mechanical fasteners such as nails, clips or screws through holes 25, or with known techniques.

As shown in FIG. 1, cover 20 includes opening or aperture 26 to permit the throughput of loose paper end 28. In one embodiment of the invention, aperture 26 is formed in a protrusion such as spout 30, which in turn is attached to or formed in cover 20. Aperture 26 is shown on the lower side of spout 30 to resist the intrusion of foreign matter such as water or dirt into the interior of housing 10. In this embodiment of the invention, spout 30 protects roll 12 by shielding roll 12 from moisture typically found in bathroom and kitchen environments.

Aperture 26 can be sufficiently large to facilitate the retrieval of loose paper end 28 from within housing 10, or aperture 26 can be sufficiently small to prevent the insertion of foreign objects into the interior of housing 10. Aperture 26 can provide a smooth or serrated edge for facilitating the separation of a portion of loose paper end 28 from roll 12. However, the perforated lines defining individual paper sheets in a conventional toilet paper roll provide a separation line in paper end 28 without the need for additional cutting means.

When cover 20 is engaged with housing 10 to enclose roll 12, cover 20 slightly compresses roll 12 by pressing roll 12 against base 16. The amount of such compression can be controlled by modifying the distance between cover 20 and base 16. Alternatively, the amount of such compression can be controlled by attaching inserts to cover 20 or base 16 as more throroughly described below.

By compressing roll 12, the present invention stabilizes roll 12 within housing 10, and retains roll 12 in a stationary position. Roll 12 is formed from a single paper strip wound into numerous layers. When roll 12 is whole, the individual wound layers of roll 12 provide structural stability to roll 12. As paper end 28 is withdrawn from the inside of roll 12, the circular core space of roll 12 becomes larger, and the span of the arched void in the core of roll 12 becomes larger. As this span is enlarged by the continued withdrawal of paper from roll 12, the upper layers of roll 12 will tend to sag downwardly. If roll 12 is loose in housing 10, the upper layers of roll 12 will eventually collapse, thereby interfering with continued dispensing of loose paper end 28. The present invention overcomes this problem by statically compressing roll 12 to a degree sufficient to prevent this sag.

The static containment of roll 12 permits double ply or single ply paper to be used, and permits lighter weight paper to be used. Additionally, the elimination of the cardboard core in conventional toilet paper rolls significantly reduces the weight and expense of the toilet paper roll and handling costs.

Figure 3:
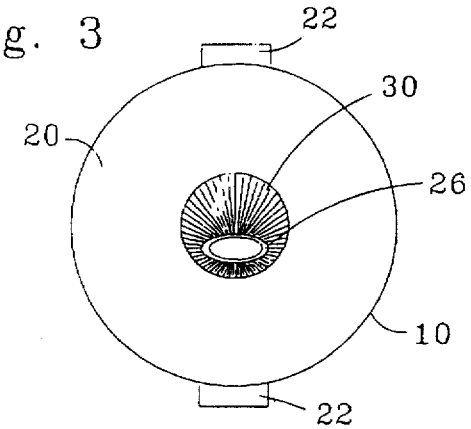
FIG. 3 illustrates a front elevation view of the invention.

As shown in FIG. 3, a front elevation view of the invention is shown wherein cover 20 is attached to housing 10, and loose paper end 28 protrudes through aperture 26. Spout 30 points downwardly in FIG. 3, but could swivel or move independently of cover 20 to permit the selective orientation of aperture 26.

Figure 4:
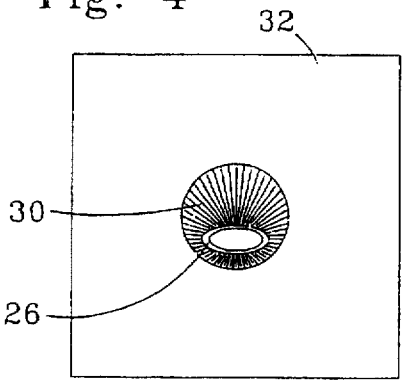
FIG. 4 illustrates a front elevation view of an alternative embodiment of the present invention.

FIG. 4 illustrates an alternative embodiment of the invention wherein the exterior surface of housing 32 is rectangular instead of cylindrical. It will be appreciated that the exterior surface of housing 32 can take many different forms and shaped without affecting the functional result provided by the invention. The inner surface of housing 32 can also be rectangular, since the compression provided by the cover against the base prevents sag of toilet paper roll 12. In another embodiment of the invention, the lower part of housing 32 could be curved to the contour of toilet paper roll 12, while the upper interior surface of housing 12 could be rectangular or another shape.

Figure 5:
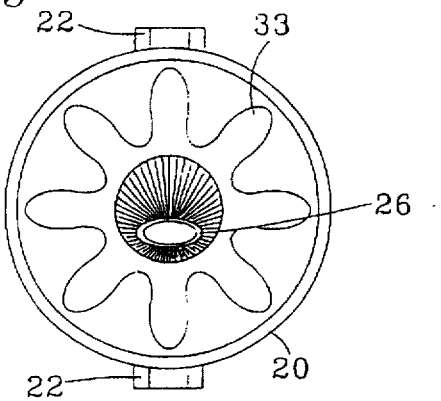
FIG. 5 illustrates a plan view of a cover having an attached flexible material.
Figure 6:
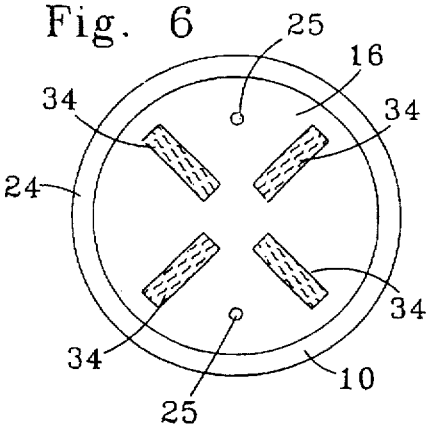
FIG. 6 illustrates a plan view of a base having an attached flexible material.

Different static components can be incorporated into the invention to selectively control the compression provided by the cover and by the base. As shown in FIG. 5, flexible or resilient caulking 33 can be attached to the interior of cover 20 to contact paper roll 12. In another embodiment of the invention shown in FIG. 6, flexible or resilient material such as cushions 34 can be attached to base 16 to affect the compressive force provided between cover 20 and base 16. In other embodiments, other stationary, inflexible features such as dimples or protrusions can extend from cover 20 or from base 16 to contact toilet paper roll 12. This flexible, inflexible or resilient or nonresilient material does not have to extend in full contact with the entire side profile of roll 12, but could selectively contact portions of roll 12 to accomplish the function of preventing collapse of roll 12.

Figure 8:
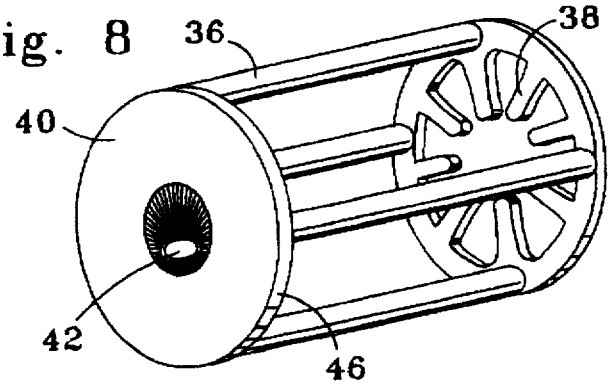
FIGS. 7 and 8 illustrate an embodiment of the invention suitable for installation in a wall cavity.
Figure 7:
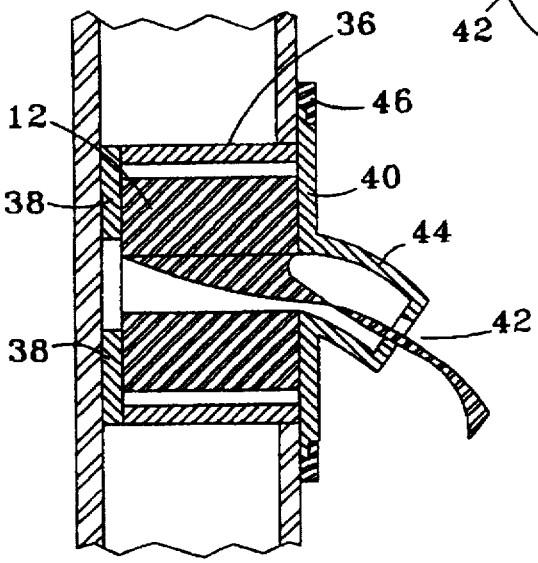

Another embodiment of the invention is described in FIGS. 7 and 8, wherein housing 36 is attached to a vertical wall. Housing 36 defines an interior space for holding paper roll 12, and substantially fits within the cavity of the vertical wall in a preferred embodiment of the invention. Base 38 is attached to housing 36, and contacts one planar end of cylindrical paper roll 12. The opposing planar end of paper roll 12 contacts cover 40, which is moveably engaged with housing 36 to permit the insertion of paper roll 12 within housing 36 interior space. Aperture 42 is attached to a cone shaped funnel 44 which guides the loose paper end of paper roll 12 toward aperture 42, and minimizes accidental tearing or separation of paper roll 12.

As shown in FIG. 8, base 38 can be formed integrally with housing 36 into a single element, and housing 36 can include flange 46 for contacting the outside vertical surface of the wall. Base 38 and housing 36 can entirely enclose paper roll 12 within the wall cavity, or can contain open windows as shown in FIG. 8. In one embodiment of the invention, base 38 can be glued or otherwise adhered to the opposing interior surface of the wall cavity, as shown in FIG. 7.

Figure 9:
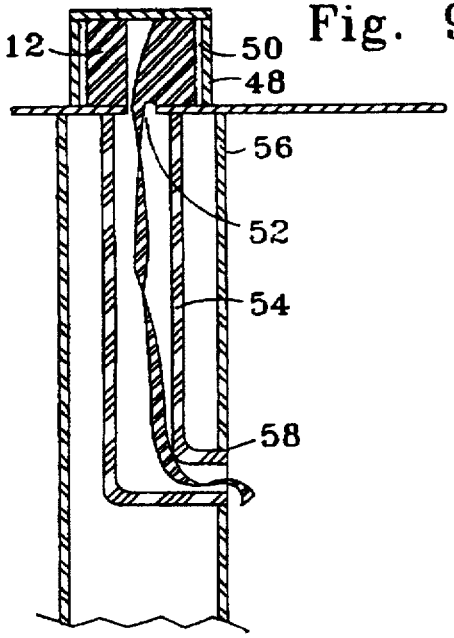
FIGS. 9 and 10 illustrate an embodiment of the invention attached to a horizontal surface such as a ceiling.
Figure 10:
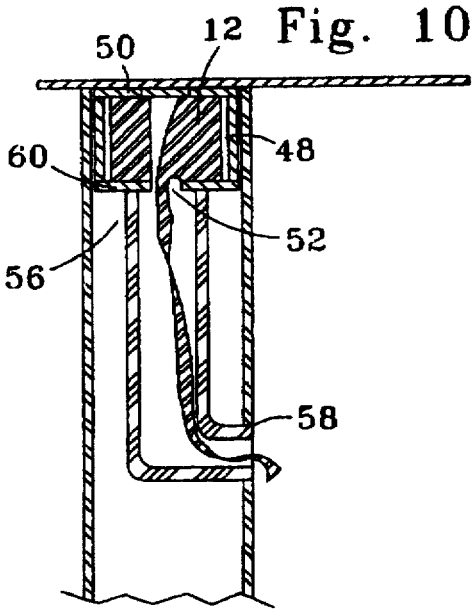

FIG. 9 illustrates one embodiment of the invention wherein housing 48 having base 50 is attached to the upper horizontal surface of a ceiling. Aperture 52 extends through base 50 to permit the withdrawal of the loose paper end therethrough. In an alternative embodiment of the invention, tube 54 has a first end 56 attached to aperture 52, and has a second end 58. The loose paper end of paper roll 12 can be pulled through aperture 52, tube first end 56, and through tube second end 58. Tube 54 can be encapsulated with the cavity of a vertical wall attached to the horizontal ceiling so that access to paper roll 12 is restricted. In an alternative embodiment of the invention shown in FIG. 10, housing 48 can be mounted on the underneath surface of the ceiling, and aperture 52 can extend through cover 60 to permit the discharge of the loose paper end from the interior space defined by housing 48. Tube first end 56 can be engaged with aperture 52.

Although the invention has been described in terms of certain preferred embodiments, it will become apparent to those of ordinary skill in the art that modifications and improvements can be made to the inventive concepts herein without departing from the scope of the invention. The embodiments descried herein are merely illustrative of the inventive concepts and should not be interpreted as limiting the scope of the invention.

I claim:

1. An apparatus for attachment to a horizontal surface for containing a cylindrical toilet paper roll having opposing planar surfaces, a hollow center, and a loose end in the hollow center, comprising:

a housing attachable to the horizontal surface and defining an interior space for holding the toilet paper roll;

a base attached to said housing for contacting one planar surface of the toilet paper roll; and an aperture in said base for permitting the loose end of the toilet paper roll to be withdrawn through said base.

2. An apparatus as recited in claim 1, wherein said horizontal surface comprises a ceiling.

3. An apparatus as recited in claim 2, further comprising a cover engaged with said housing and moveable to permit the placement of the toilet paper roll within said housing interior space, wherein said cover is engagable with said housing to press against one planar surface of the toilet paper roll so that the opposing toilet roll planar surface contacts said base, and wherein said aperture extends through said cover.

4. An apparatus as recited in claim 1, further comprising a tube having a first end attached to said aperture and having a second open end opposite from said first end, wherein the toilet paper loose end is withdrawable through said tube first end and through said tube second end.

5. An apparatus as recited in claim 4, wherein said horizontal surface comprises a ceiling attached to a vertical wall having a hollow cavity, and wherein said tube is extendable through the vertical wall hollow cavity.

* * * * *